US005544710A

United States Patent [19]

Groshans et al.

[11] Patent Number: 5,544,710

[45] Date of Patent: Aug. 13, 1996

[54] PULSE TOOL

[75] Inventors: Joseph R. Groshans, Clinton; Jeffrey Spooner, West Winfield; Seth A. Jones, Camden, all of N.Y.

[73] Assignee: Chicago Pneumatic Tool Company, Utica, N.Y.

[21] Appl. No.: 262,638

[22] Filed: Jun. 20, 1994

[51] Int. Cl.[6] ..... B25B 21/00

[52] U.S. Cl. ..... 173/176; 173/93.5

[58] Field of Search ..... 173/176, 177, 173/178, 93.5, 93

[56] References Cited

U.S. PATENT DOCUMENTS

| | | | |
|---|---|---|---|
| 3,643,749 | 2/1972 | Pauley | 173/93.5 |
| 4,108,252 | 8/1978 | Stroezel | 173/176 |
| 4,418,764 | 12/1983 | Mizobe | 173/177 |
| 4,920,836 | 5/1990 | Sugimoto et al. . | |
| 5,080,181 | 1/1992 | Tatsuno | 173/93.5 |
| 5,092,410 | 3/1992 | Wallace et al. | 173/93.5 |

FOREIGN PATENT DOCUMENTS 0105038 4/1984 European Pat. Off. .

*Primary Examiner*—Scott A. Smith
*Attorney, Agent, or Firm*—Schmeiser, Olsen & Watts

[57] ABSTRACT

The invention is an impulse wrench that employs a fluid coupling between its anvil and hammer members. The tool includes a pulse cylinder that forms the tool's hammer and has a shaped inner surface that defines a side wall of a fluid-filled chamber. An end portion of the anvil is received within the chamber and includes two retractable vanes that sweep the pulse cylinder's inner surface when the pulse cylinder is rotating about the anvil. To achieve only a single impact per revolution of the pulse cylinder, fluid bypass channels are employed to intermittently allow fluid to pass around the vanes. In addition, the tool includes a unique torque-sensing shut-off mechanism that is engaged to the tool's motor and makes use of inertia force to actuate a power shut-off device.

26 Claims, 4 Drawing Sheets

PULSE TOOL

FIELD OF THE INVENTION

The invention is in the field of tools that deliver an impulse to a workpiece. More particularly, the invention is an impulse wrench in which the impact pulse is created by a fluid lock-up between the tool's hammer and anvil. The hammer is cylindrical in shape and rotates about the anvil. The anvil has an elongated body and two outwardly-extending vanes. The anvil vanes reside in a fluid-filled chamber whose outer wall is partially formed by a shaped inner surface of the cylindrical hammer. During operation of the tool, the vanes continually sweep the inner surface of the hammer and once per revolution, a pressurization of the chamber is achieved which causes the hammer cylinder to become locked to the anvil. The tool further features a unique torque-sensing shut-off mechanism that is triggered by the change in hammer speed at the time of the impact.

BACKGROUND OF THE INVENTION

Impact tools of the wrench or rotary type typically include an electric or air powered motor that is linked to a hammer member. At spaced intervals, the hammer member comes into an abrupt engagement with an anvil member that is operatively connected to a workpiece such as a fastener or some other element that is having work done to A major problem area of the prior art tools of this type is in the method and structure used for engaging the hammer to the anvil. Due to the abruptness of the contact and the high stresses involved in the transfer of energy to make the impact, the engagement structure that temporarily engages the hammer and anvil is prone to a high rate of wear and failure. This problem appears to be inherent in the mechanical coupling between these two components of the tool. While there have been numerous different methods invented for achieving the temporary coupling between the hammer and anvil, excessive wear and premature failure in the coupling elements continue to be problematic.

There have been some prior art tools in which a fluid clutch is employed to intermittently lock the hammer to the anvil. These tools can suffer from a heat buildup in the clutch fluid (usually oil) which causes the fluid and nearby seals to break down or deteriorate. This heating of the oil is normally a result of the manner in which the fluid is allowed to bypass during the impact/impulse portion of the tool's cycle.

Another problem often suffered by prior art impact/impulse wrenches is that when they employ a sensor designed to shut off the tool when a certain torque limit is reached, the sensing mechanism may be overly complicated and/or inaccurate. In the case of tools that employ a fluid clutch, there is the additional problem that the shut-off mechanism (typically a pressure-sensitive relief valve) causes the tool to vary its impact/impulse energy as the tool approaches its shutoff point. This leads to inaccurate or uncertain torquing of the fastener. In addition, the shut-off mechanism can adversely affect the speed of the tool since some of the tool's energy is going into heating of the fluid.

SUMMARY OF THE INVENTION

The invention is a reversible impulse wrench that includes a hydraulic locking/clutch mechanism that functions to intermittently lock the tool's pulse cylinder (hammer) to the rotatable anvil. The pulse cylinder is cylindrical in shape and is connected to, and rotates with, the tool's motor. The anvil is in the form of an elongated shaft that has one end designed to engage a workpiece via a socket or similar element.

The locking/clutch mechanism makes use of an oil-filled area created between the shaft of the anvil and a shaped inner surface of the pulse cylinder. Two movable vanes extend outwardly from the anvil shaft and follow the contours of the inner surface of the pulse cylinder and thereby effectively divide the fluid-filled area into two separate compartments. The vanes periodically engage inwardly-directed complementary seal structures located on the interior surface of the pulse cylinder. The locking/clutch mechanism is designed so that when the anvil vanes contact the seals of the pulse cylinder at a predetermined point in the pulse cylinder's rotation, the two fluid-tight compartments become pressurized and, due to the minimal compressibility of the fluid, lock together the pulse cylinder and the anvil. Once locked together, a pulse or impulse is created as the anvil attempts to rotate in the same direction as the pulse cylinder.

After the impulse, fluid movement reduces the pressure differential between the two compartments. This allows the pulse cylinder to once again move about the anvil and thereby regain its momentum through the aid of the tool's motor.

To maximize the energy of each impulse, it is desirable for there to be only a single impulse for every revolution that the pulse cylinder makes about the anvil. Since the anvil's two vanes extend from opposite sides of the anvil shaft (to maintain a balanced force on the anvil), contact is made twice per revolution with the two seal members located on the inner surface of the pulse cylinder. Therefore, oil porting structure is employed to prevent locking between the pulse cylinder and the anvil at the half revolution point. The porting is in the form of a series of channels located in the anvil and its surrounding structure that allow the oil to bypass the vanes and thereby prevent a pressure buildup between the two separated areas. At the point where the pulse cylinder has made a full revolution about the anvil, the oil ports are blocked to prevent the passage of oil, thereby creating a lock-up condition between the pulse cylinder and the anvil.

The tool further includes a torque-sensing apparatus that is designed to shut off the tool once the anvil is applying a predetermined level of torque to a workpiece. This is accomplished using an inertia shaft that is releasably engaged to the rotor of the tool's motor. The shaft includes a flywheel portion that is designed to maintain the rotary momentum of the shaft. When the tool applies an impulse to the anvil, the shaft of the tool's motor is temporarily slowed or stopped since it is directly connected to the pulse cylinder. At the time of impulse, the inertia shaft is free to rotate relative to the rotor of the motor. Due to the action of a ball on a cam surface, the inertia shaft will then move in a rearward direction against a spring. If the difference in speed between the inertia shaft and motor is great enough, the force causing the rearward movement of the inertia shaft will be sufficient to overcome the spring force and the inertia shaft will move to a predetermined rearward point. At that predetermined point, the shaft engages a shut-off device that shuts off the motive force (air or electricity) to the tool's motor. A user may adjust the compression of the spring to thereby change the torque at which the tool will shut off.

It should also be noted that when the inertia shaft moves to its predetermined rearward position, it causes the opening of a fluid bypass valve in the fluid clutch. When this occurs, fluid is immediately allowed to bypass the anvil's vanes, thereby immediately disengaging the pulse cylinder from the anvil. As a result, the tool has a very high degree of accuracy in applying a predetermined torque to a fastener. In addition, by employing a shut-off mechanism that is not based on sensing the pressure of the fluid within the fluid-filled chamber (i.e.—acts independently of the fluid pressure within the clutch), the tool's efficiency and durability are maximized since significant volumes of fluid are not continually passed through relief valve structure during each of the tool's impulse cycles.

DETAILED DESCRIPTION OF THE DRAWINGS

Figure 1:
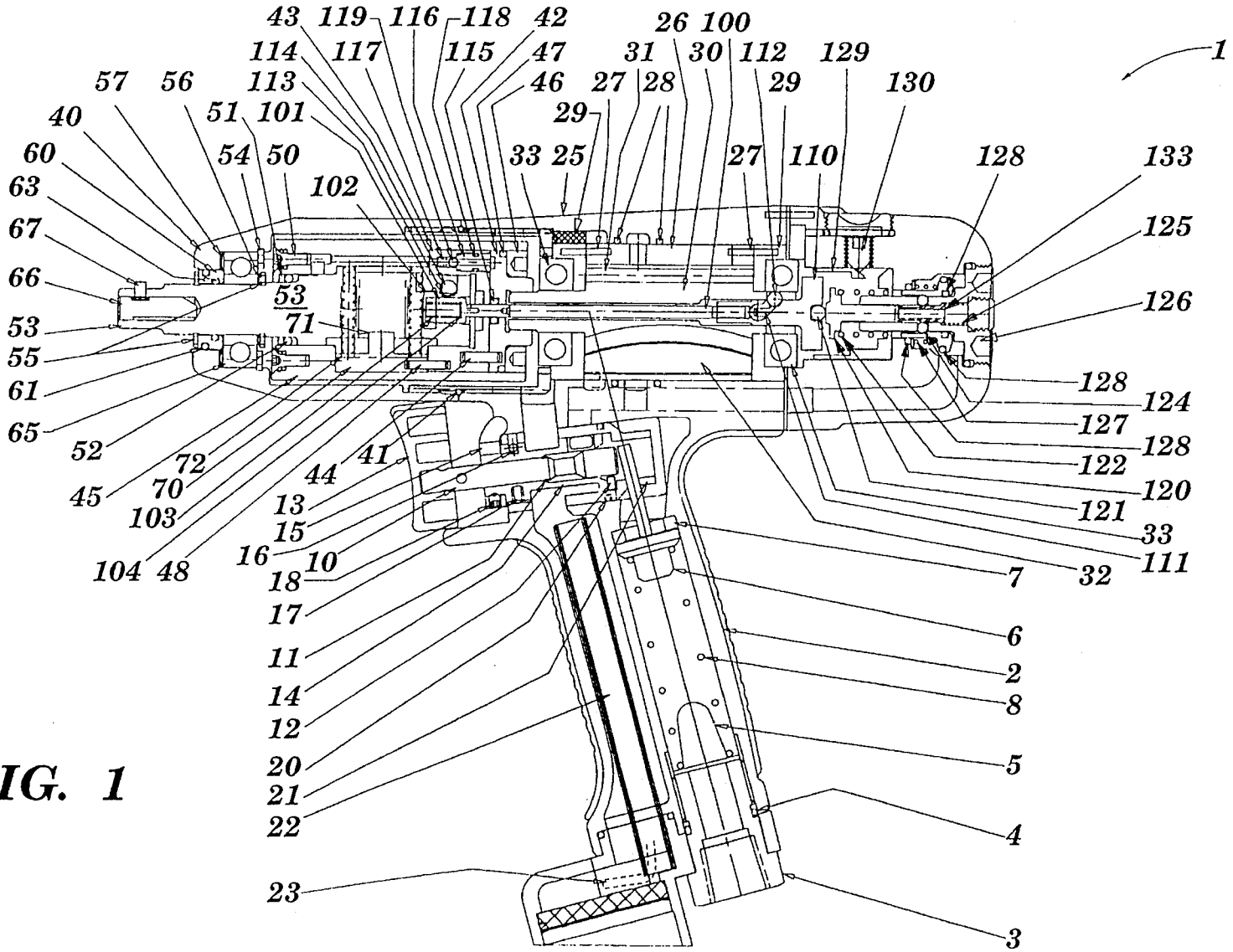
FIG. 1 is a cross-section of a pneumatically-powered impulse wrench accordance with the invention.

Referring now to the drawings in greater detail, wherein like reference characters refer to like parts throughout the several figures, there is shown by the numeral 1 a pneumatically-powered impulse wrench in accordance with the invention.

The wrench 1 has a handle section 2. The handle section contains an air inlet 3 with an adjacent 'O'-ring 4, air strainer 5, throttle valve 6 with complementary seat 7 and biased by a spring 8. The valve is actuated by a throttle pin 10 that has a snap ring 11, fits within a washer 12 and is connected to the tool's trigger 13.

The tool further includes a reverse valve 14 that is engaged by a lever 15. The lever is maintained in position by a pin 16 and a detent pin/spring unit 17 with a set screw 18. Exterior to the assembly is an 'O'-ring 20 and a bushing 21. The tool's air outlet includes a foam diffuser 22 held in place by a retainer 23.

The motor portion of the tool has an exterior housing 25 that surrounds a liner 26. The liner is held in place by pins 27 and contacts exterior 'O'-ring seals 28. At each end of the liner is an endplate 29. Located within the liner is the motor's rotatable rotor 30 having plugs 31 and outwardly-extending vanes 32. The rotor is supported at each end by ball bearings 33. The air inlet leads to the motor whereby pressurized air will cause the rotor 30 to spin in the conventional manner. It should be noted that while one type of air- powered motor is shown, other types of air motors or an electric motor can be substituted in its place.

Located to the left of the motor (per FIG. 1) is the portion of the tool that is responsible for creating the impulse/impact forces that will be transmitted to the workpiece (not shown). This section of the tool is partially surrounded by a housing 40 that is connected to the motor housing 25 and sealed using an 'O'-ring 41.

The rotor 30 lockingly engages drive plate 42 using a hexagonal fit between the end of the rotor and a center hole in the plate. The drive plate is locked to control plate 43 using locking pins 44 with both plates being located within the right end portion of the tool's pulse cylinder 45. A locking ring 46 maintains the plates within the pulse cylinder and an 'O'-ring 47 seals the connection. Pins 48 engage the control plate to the pulse cylinder. Therefore, when rotor 30 turns, this causes the drive plate, control plate and pulse cylinder to likewise spin.

The left end of the pulse cylinder includes a fill plug 50 that is used to fill or remove the oil from within the pulse cylinder. A counterbore in the pulse cylinder holds a retainer 51 and 'O'-ring seal 52 about the exterior of anvil 53. The pulse cylinder 45 and anvil are maintained in position by retainers 54 and 55 and wave spring washers 56 and 57. The combined anvil and pulse cylinder are further sealed by seal 60 and 'O'-rings 61 and 63, all contained within housing 40.

The anvil 53 is rotatably mounted within bearing 65. The left end of the anvil extends outwardly from the housing and has a socket receiving tip 66 that includes a socket retaining pin 67. The right portion of the anvil extends along the longitudinal centerline of the pulse cylinder and is surrounded by said cylinder. The anvil includes two vanes 70 that are retractable within slots 71 on the body of the anvil. Springs 72 bias the vanes toward an outwardly-extended position.

FIGS. 2–6 provide detailed views of the pulse cylinder 45. In these views, it can be seen that the pulse cylinder has a cylindrical interior space 81 with a nearly elliptical section (note especially FIG. 4) which can also be described as a dual eccentric chamber. The vanes 28 of the anvil are received within this space and function to divide/separate the space into two compartments. As the pulse cylinder rotates about the anvil, the anvil's vanes sweep along the inner surface 82 of the cylinder. In this manner, the inner surface of the pulse cylinder forms a first fluid engagement surface and the anvil and its vanes form a second fluid engagement surface. It should be noted that the exterior of the pulse cylinder has a knurled surface to enhance heat dissipation from the unit.

FIGS. 7–11 provide detailed views of the anvil 53. these views, one can see the vane receiving slots 71 in addition to interior porting that will be described shortly.

Figure 12:
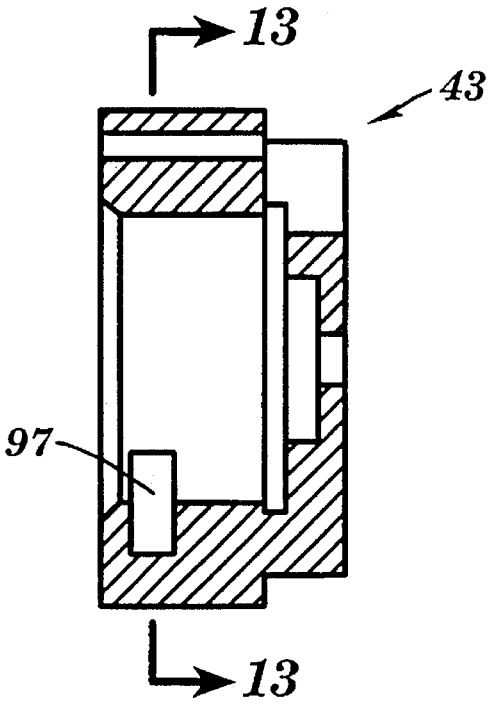
FIG. 12 is a cross-sectional view of the control plate of the tool shown in FIG. 1
Figure 13:
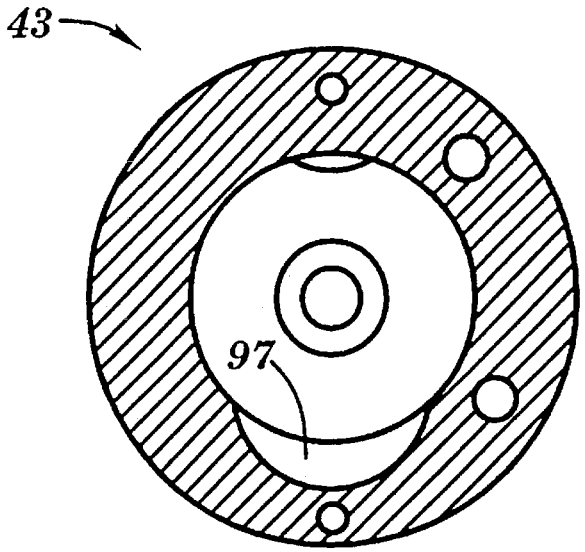
FIG. 13 is a sectional view of the control plate shown in FIG. 12 and taken at plane 13—13.
Figure 14:
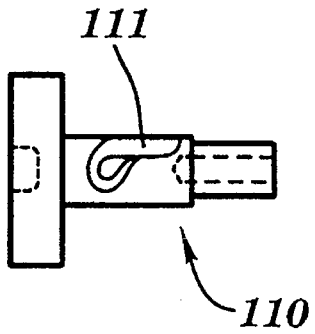
FIG. 14 is a right side end view of the control plate shown in FIG. 12.

FIGS. 12–14 provide detailed views of the control plate 43.

Figure 4:
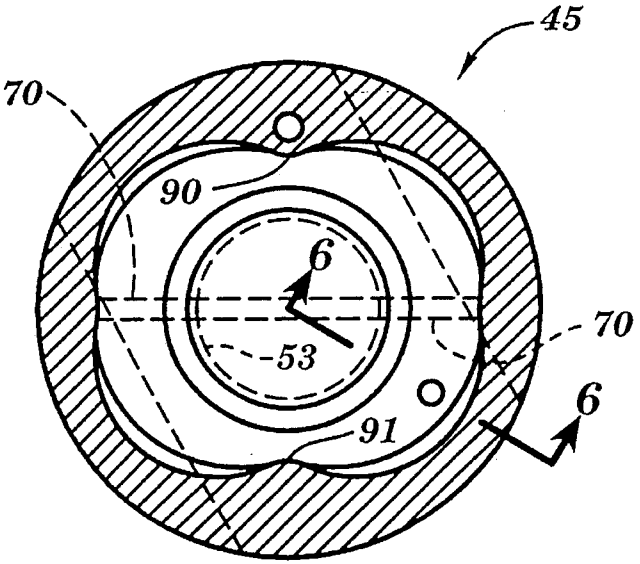
FIG. 4 is an enlarged end view of the pulse cylinder shown in FIG. 2, taken at plane 4—4.
Figure 6:
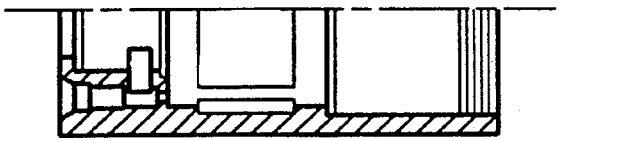
FIG. 6 is a cross-sectional end view of the pulse cylinder section shown in FIG. 4.
Figure 2:
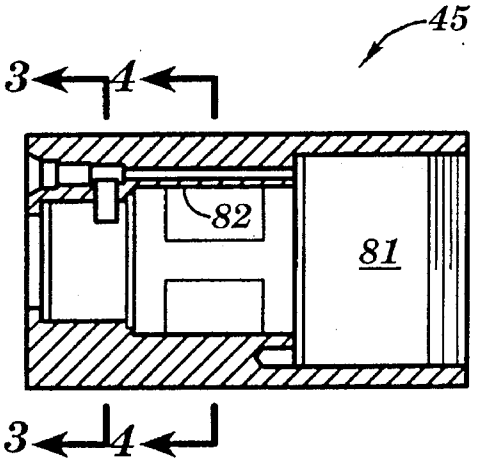
FIG. 2 is a cross-sectional view of the pulse cylinder of the tool shown in FIG. 1.
Figure 5:
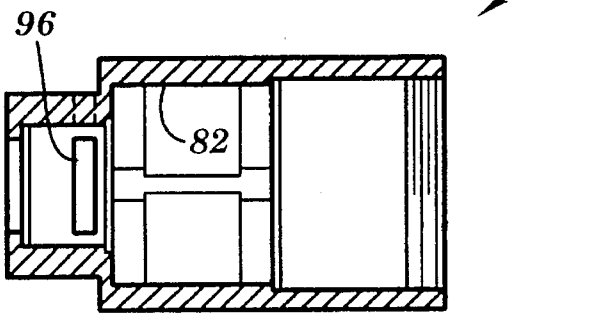
FIG. 5 is a cross-sectional view of the pulse cylinder of the tool show in FIG. 1, taken ninety-degrees from the view shown in FIG. 2.
Figure 3:
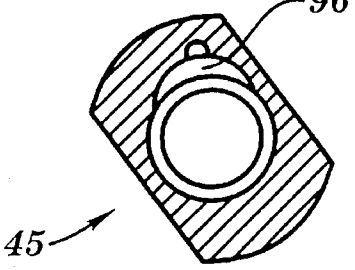
FIG. 3 is a cross-section of the pulse cylinder shown in FIG. 2, taken at plane 3—3
Figure 7:
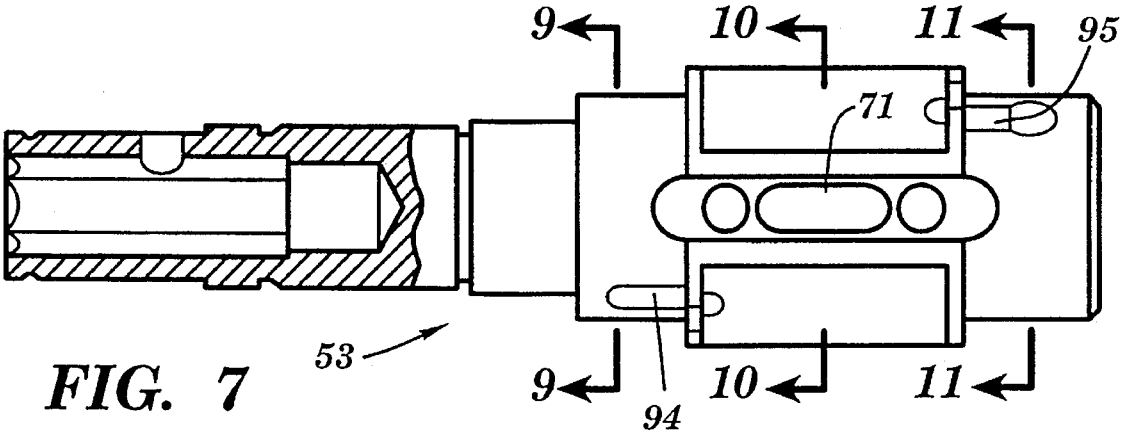
FIG. 7 is a side view, partially in cross-section of the anvil of the tool shown in FIG. 1.
Figure 8:
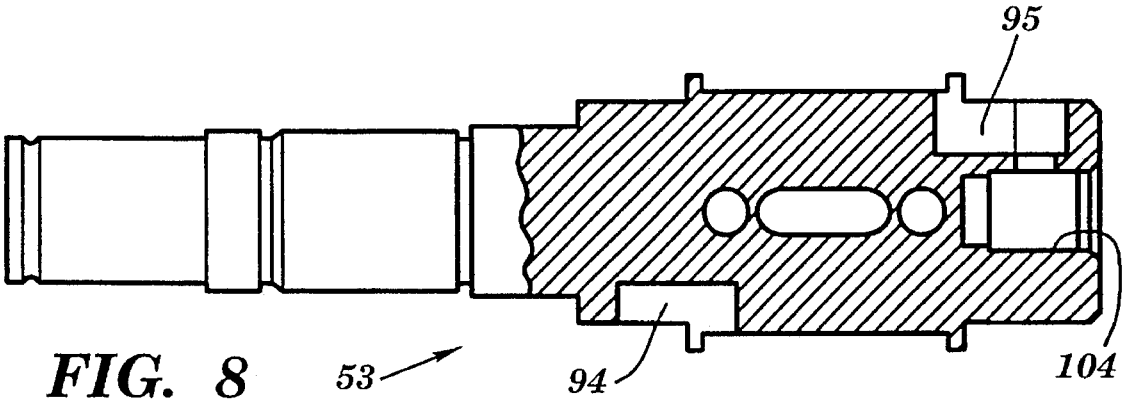
FIG. 8 is a side view, partially in cross-section of the anvil of the tool shown in FIG. 1
Figure 9:
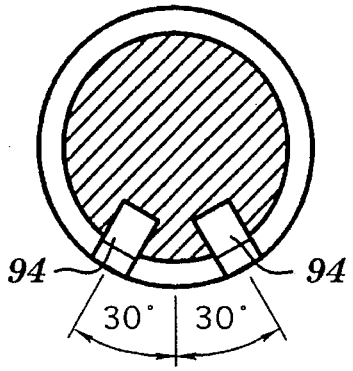
FIG. 9 is a cross-sectional view of the anvil shown in FIG. 7 taken at plane 9—9
Figure 10:
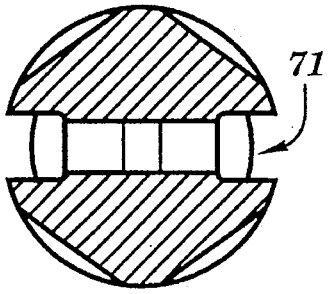
FIG. 10 is a cross-sectional view of the anvil shown in FIG. 7 taken at plane 10—10.
Figure 11:
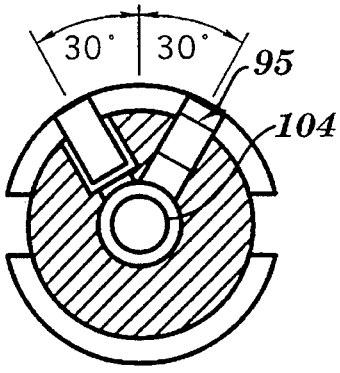
FIG. 11 is a cross-sectional view of the anvil shown in FIG. 7 taken at plane 11—11.

When the area within the pulse cylinder surrounding the anvil's vanes 70 is full of a fluid such as oil, the vanes effectively divide the area into two oil-filled compartments whose volume is determined by the contour of the inner surface 82 of the pulse cylinder and the external surface of the anvil (note FIGS. 1 and 4). This effectively forms a fluid coupling mechanism between the anvil and the pulse cylinder. The rotation of the pulse cylinder causes the oil to be swept by the anvil vanes in a manner similar to a vane pump.

As the anvil's vanes reach the inwardly-extending sealing regions 90 and 91 of the pulse cylinder (note FIG. 4), the volume of each of the divided compartments changes due to the contour of the inner surface 82 of the pulse cylinder. At this point, if each compartment is substantially leak-free, the anvil effectively becomes locked to the pulse cylinder and thereby imparts an impact pulse to the workpiece as momentum energy is transferred from the rotating pulse cylinder to the relatively stationary anvil.

It should be noted that a very slight amount of the fluid will be able to leak past the sealing regions 90 and 91. This allows the pulse cylinder to disengage the anvil at the end of the pulse cycle.

To maximize the impact force, it is desirable to achieve only a single lock-up of these components during one full revolution of the pulse cylinder about the anvil. To accomplish this, the anvil has two sets of ports/channels, 94 and 95 (note FIGS. 7–11) that allow the oil to bypass around the vanes via complementary grooves 96 and 97 in the pulse cylinder (note FIGS. 3 and 5) and control plate (note FIGS. 12 and 13) respectively. In this manner, the oil in the compartments separated by the anvil's vanes becomes pressurized once per revolution of the pulse cylinder at the time when the anvil ports 94 and 95 are not mated to the complementary grooves 96 and 97 of the pulse cylinder and control plate. It should be noted that each of the two port/groove pairs (pair one is 94, 96 and pair two is 95, 97) forms a fluid bypass channel that will, therefore, intermittently allow oil to bypass the vanes 70. It should also be noted that these fluid bypass channels are at a 180 degree offset from each other to produce balanced loading on the anvil and thereby reduce overall vibration in the tool.

To the right (per FIG. 1) of the tool's motor is the tool's shut-off mechanism. This mechanism is linked to the tool's fluid coupling via a long rod 100 that passes through the rotor 30 and abuts piston 101. The piston is received within an opening 104 in the anvil which is in fluid communication with ports 95. In this manner, when the piston is in its forward position, it blocks any transfer of oil via opening 104 between the oil-filled compartments separated by the anvil's vanes 70. The piston meets a stop 102 and is biased rearwardly by a spring 103.

Figure 15:
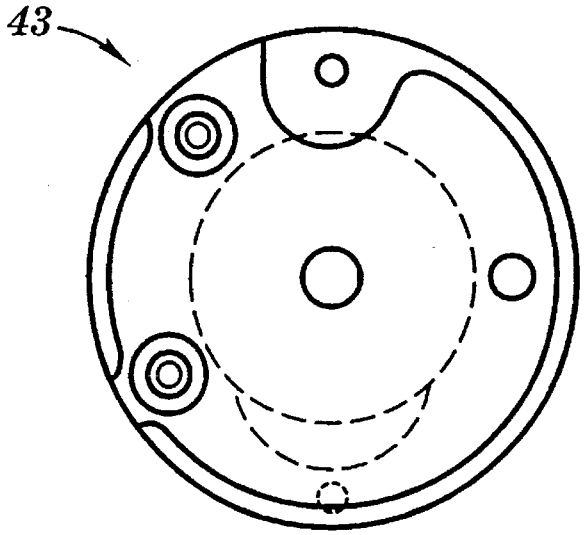
FIG. 15 is a detailed side view of the inertia shaft of the tool shown in FIG. 1.

Releasably engaged to rotor 30 of the tool's motor is an inertia shaft 110. At the point shown in FIG. 1, ball 112 is positioned to lock the inertia shaft to the rotor. When the oil pressure within the fluid coupling has reached a level where the pulse cylinder and anvil have become locked together, this will cause the rotor 30 to either slow or to stop. When this occurs, the inertia shaft will continue to rotate and also move in a rearward direction as groove 111 of the shaft (note FIGS. 1 and 15) rides over ball 112. Rod 100 is rigidly attached to the inertia shaft and therefore the rod and spring-biased piston 101 also move rearwardly in concert with the inertia shaft. Once piston 101 has moved back to its rearward position (at the tool's shut-off torque), it allows oil to pass from one of the ports 95 to the other port 95 via opening 104. This equalizes pressure in the compartments separated by the anvil's vanes and allows the pulse cylinder to disengage from the anvil thereby relieving excess pulse energy at the tool's shut-off torque The valve formed by ball 114 and its complementary seat is primarily for non-shut-off operation of the tool and acts as a reverse check valve for the tool and allows the tool to maintain full power when operated in reverse. In this manner, proper porting and maximum pressure and torque will be achieved when the pulse cylinder is rotating in a reverse direction.

To reduce seal friction, seal wear and heat build-up in the area sealed by 'O'-ring 115 (surrounding rod 100 and piston 101) and the area behind the sealing area of o-ring 52, the tool includes relief check valves 116 that are biased by springs 117 and include an 'O'-ring 118 and ball 119. These two valves limit seal pressure when the tool is operating in a forward or reverse direction.

When the inertia shaft 110 moves rearwardly, the end of the shaft bears on a shut-off pin 120 via a ball 121. The shut-off pin is biased against rearward movement by an adjustable spring 122. If sufficient torque is being applied to the workpiece, the change in the velocity of rotor 30 relative to the inertia shaft 110 during an impulse will cause the inertia shaft and shut-off pin to move back against spring 122. At the maximum or set point, the shut-off pin engages a shut-off escapement 123, which in its forward position outwardly displaces balls (124) to maintain the air-biased shut-off valve in its "open" position. When the escapement moves against spring 125 in a rearward direction, it allows balls 124 to move inwardly, thereby allowing shut-off valve 126 to move to a closed position and thereby shut off the flow of air to the tool's motor. It should be noted that the shut-off valve includes a reset spring 127 and a seals 128. Since the shut-off valve is pneumatically biased toward a closed position, a user must release the trigger and thereby allow the valve to reset before the tool can be used to drive another fastener.

To enable a user to adjust the torque setting at which the tool is shut off, the tension of spring 122 can be adjusted. This is accomplished by moving adjustment sleeve 129 via an accessible adjustment screw 130.

The embodiment disclosed herein has been discussed for the purpose of familiarizing the reader with the novel aspects of the invention. Although a preferred embodiment of the invention has been shown and described, many changes, modifications and substitutions may be made by one having ordinary skill in the art without necessarily departing from the spirit and scope of the invention as described in the following claims.

I claim:

1. An impulse tool comprising:

a pulse cylinder rotatable by a motor;

a rotatable anvil member having a first end portion that extends outwardly from said tool;

a fluid coupling means that functions to intermittently couple said pulse cylinder to said anvil member, a first fluid engagement means associated with said pulse cylinder and a second fluid engagement means associated with the anvil member whereby the first and second fluid engagement means act in conjunction to form first and second separated areas within the fluid-filled chamber and intermittently cause one of said areas to become pressurized to thereby form a fluid link between the pulse cylinder and the anvil member which acts to transfer an impact pulse to the anvil member from the pulse cylinder; and at least one fluid bypass channel including a first portion located on the anvil member and a second portion located on the pulse cylinder, said channel operatively associated with the fluid coupling means, said at least one fluid bypass channel located to allow the intermittent flow of fluid from the first separated area to the second separated area.

2. The tool of claim 1 wherein the pulse cylinder has an interior surface that defines a side wall of the fluid-filled chamber.

3. The tool of claim 2 wherein the anvil member has a second end portion that is received within and is surrounded by said pulse cylinder.

4. The tool of claim 3 further comprising a control plate that is connected to and rotatable with the pulse cylinder and forms a rear wall of the fluid-filled chamber.

5. The tool of claim 4 wherein at least two fluid bypass channels are located on the anvil member on an end portion of the pulse cylinder and on the control plate.

6. The tool of claim 5 wherein the fluid bypass channels include ports in the anvil member that are located to intermittently align with and open into complementary grooves in the front portion of the pulse cylinder and in the control plate when said pulse cylinder is rotating about the anvil member.

7. The tool of claim 4 wherein the control plate is disk-shaped and a pressure relief valve is located proximate an outer edge of said control plate.

8. The tool of claim 3 wherein the first fluid engagement means is in the form of a shaped interior surface of the pulse cylinder and wherein the second fluid engagement means is in the form of a body portion of the anvil and two vane members that are retractably received in opposite sides of said body portion of the anvil member and wherein when the pulse cylinder rotates about the anvil member, the vane members sweep said shaped interior surface of the pulse cylinder.

9. The tool of claim 8 wherein the vane members are biased toward an outward position by a spring means.

10. The tool of claim 1 wherein the pulse cylinder has an end portion that forms a front wall of the fluid-filled chamber.

11. The tool of claim 1 wherein the fluid coupling means further comprises a vane means that is movable within the fluid-filled chamber.

12. The tool of claim 1 further comprising a shut-off mechanism that includes a torque-sensing means and a power shut-off means, said torque sensing means functioning to sense the amount of torque being applied to a workpiece by the anvil member, said power shut-off means being operatively connected to the tool's motor and capable of stopping a flow of power to said motor.

13. The tool of claim 12 wherein the torque-sensing means is operatively connected to the tool's motor.

14. The tool of claim 13 wherein the torque-sensing means includes an inertia shaft that is engaged to and rotatable with the tool's motor and wherein a cam means is connected to the inertia shaft and functions to move the inertia shaft in a direction along a longitudinal axis of said shaft when the tool's motor decreases in speed at the instant when the pulse cylinder is locked to the anvil member by the fluid coupling means.

15. The tool of claim 14 wherein when the inertia shaft is moved a predetermined distance along its longitudinal axis, said shaft causes the power shut-off means to be actuated.

16. The tool of claim 15 further comprising an adjustable spring means that biases the inertia shaft in a direction opposite to that which would lead to the actuation of the power shut-off means.

17. The tool of claim 15 wherein the inertia shaft is operatively engaged to a fluid bypass valve that has a first portion in fluid contact with the fluid in the fluid-filled chamber.

18. The tool of claim 17 wherein the fluid bypass valve is engaged to a first end portion of a rod member, said rod member having a second end portion that is connected to the inertia shaft and wherein said fluid bypass valve is in the form of a piston that is received within a complementary cylindrical bore in a second end portion of the anvil member and wherein said bore has side openings that lead to two spaced-apart areas of the fluid-filled chamber.

19. The tool of claim 1 wherein the pulse cylinder has an interior surface that, in section, forms a dual eccentric shape that defines the first fluid engagement means.

20. An impulse tool comprising:

a pulse cylinder rotatable by a motor;

a rotatable anvil member having a first end portion that extends outwardly from said tool;

a fluid coupling means that functions to intermittently couple said pulse cylinder to said anvil member, wherein said fluid coupling means includes a fluid-filled chamber, a first fluid engagement means associated with said pulse cylinder and a second fluid engagement means associated with the anvil member whereby the first and second fluid engagement means act in conjunction to form first and second separated areas within the fluid-filled chamber and intermittently cause one of said areas to become pressurized to thereby form a fluid link between the pulse cylinder and the anvil member which acts to transfer an impact pulse to the anvil member from the pulse cylinder; and a shut-off mechanism that includes a fluid bypass valve operatively connected to two spaced-apart areas of the fluid-filled chamber, a torque sensing means and a power shut-off means, said torque sensing means functioning to sense the amount of torque being applied to a workpiece by the anvil member, said power shut-off means being actuable by the torque sensing means and operatively connected to the tool's motor and capable of stopping a flow of power to said motor and wherein said fluid bypass valve only opens when the torque sensing means senses a predetermined torque being applied to the workpiece.

21. The tool of claim 20 wherein said torque sensing means includes a rotatable member that is operatively connected to the tool's motor.

22. The tool of claim 21 wherein a cam means is connected to the rotatable member and functions to move said member in a direction along a longitudinal axis of said member when the tool's motor decreases in speed at the instant when the pulse cylinder is locked to the anvil member by the fluid coupling means.

23. The tool of claim 21 wherein the rotatable member is operatively engaged to the fluid bypass valve.

24. A power tool comprising:

a housing;

a motor within said housing;

a pulse cylinder, operatively coupled to said motor; and an anvil, rotatably mounted with respect to said pulse cylinder, said pulse cylinder and said anvil defining a pulse chamber therebetween, said pulse chamber including a high pressure area and a low pressure area, wherein said pulse cylinder and said anvil each have a channel therein fluidically coupling said high pressure area to said low pressure area of said pulse chamber to create a pulse by intermittently locking the pulse cylinder to the anvil.

25. The power tool of claim 24, further comprising a control plate that is connected to and rotatable with the pulse cylinder.

26. The power tool of claim 25, further comprising a fluid bypass channel in the control plate.

* * * * *